US006119556A

United States Patent [19]

Hillier et al.

[11] Patent Number: 6,119,556

[45] Date of Patent: Sep. 19, 2000

[54] COMBINATION PRECISION PUNCH ASSEMBLY AND GUIDE/MATRIX ASSEMBLY AND METHOD OF PRECISION INSTALLATION OF A PUNCH SET

[76] Inventors: James R. Hillier, 730 Edgemere La.; Kenneth R. Hillier, 5017 Sandy Shores Ave., both of Sarasota, Fla. 34242

[21] Appl. No.: 09/128,170

[22] Filed: Aug. 3, 1998

[51] Int. Cl.[7] ..... B21K 5/20

[52] U.S. Cl. ..... 76/107.1; 76/4; 156/293; 29/465

[58] Field of Search ..... 76/107.1, 4; 83/129–146, 83/684–691; 156/293, 294, 252, 256, 257; 29/465

[56] References Cited

U.S. PATENT DOCUMENTS

| | | | |
|---|---|---|---|
| 3,125,974 | 3/1964 | Toulmin | 72/483 |
| 3,126,776 | 3/1964 | Whistler, Sr. et al. | 76/107.1 |
| 3,228,262 | 1/1966 | Bennett | 76/107.1 |
| 3,230,806 | 1/1966 | Revoldt | 83/146 |
| 3,404,055 | 10/1968 | Wieland et al. | 156/294 |
| 3,504,576 | 4/1970 | Silberman et al. | 76/107.1 |
| 3,540,314 | 11/1970 | Howard | 76/107.1 |
| 3,999,279 | 12/1976 | O'Neal et al. | 29/458 |
| 4,359,915 | 11/1982 | Nascimento | 76/107.1 |
| 4,555,840 | 12/1985 | Nakamura | 76/107.1 |
| 5,303,618 | 4/1994 | Norell | 76/107.1 |

*Primary Examiner*—Kenneth E. Peterson
*Assistant Examiner*—Stephen Choi
*Attorney, Agent, or Firm*—Charles J. Prescott

[57] ABSTRACT

In combination, a guide body/matrix body assembly and a precision punch set assembly and method, the combination forming a precision punching system for highly accurate registration hole placement in film and plate sheet material used in subsequent precision alignment thereof on printing presses and image platemaking. The punch set assembly includes a punch guide and a punch matrix which are precision installed into the guide body and matrix body, respectively, in highly accurate fashion with respect to substantially all lineal and rotational degrees of freedom through the use of slightly oversized holes in the guide body and matrix body and a curable adhesive which fixes the precision alignment when cured. Vibration applied to the guide body/matrix body assembly during precision alignment and orientation of the punch set assembly is preferred.

1 Claim, 1 Drawing Sheet

COMBINATION PRECISION PUNCH ASSEMBLY AND GUIDE/MATRIX ASSEMBLY AND METHOD OF PRECISION INSTALLATION OF A PUNCH SET

BACKGROUND OF THE INVENTION

1. Scope of Invention

This invention relates generally to apparatus for punching holes in flat or sheet material, and more particularly to a precision punch assembly and guide body/matrix body assembly and method of punch assembly installation therein.

2. Prior Art

A high degree of accuracy is required in the alignment of three piece punch set assemblies when installed into guide body/matrix body assemblies used in alignment hole placement in high resolution film or plate media for imagers or imagesetters. Many imagers now incorporate internal punching systems that punch registration holes in film and plate media which, after exposure, are used in multiple layers photographic reproduction. The punched holes initially align each media sheet when each image is exposed and, thereafter, aid in precisely registering the images on the stack of two or more media layers in plate making for printing presses.

These internal punch systems require extremely high accuracy with very tight dimensional tolerances. The tolerances for punch-to-matrix body is typically +/−0.0002", while the accuracy of alignment with respect to parallelism and perpendicularity of the punch assembly is typically +/−0.0002" as well.

A common method for accomplishing the required precision alignment of each punch set assembly is by using machinery to form holes to receive the punch guide and punch matrix with extremely high accuracy in combination with very delicate assembly techniques. Thus, the dependency upon the machining process to establish the necessary accuracy is both labor intensive and costly as the machinery used to accomplish this degree of accuracy is considerably higher in equipment costs.

A method of making precision die sets is disclosed in U.S. Pat. No. 3,504,576 invented by Silberman. However, this reference teaches the utilization of a curable adhesive for permanently securing guide posts between a die shoe or holder and a punch holder, the curable adhesive being placed between slightly enlarged holes formed in the die shoe and the lower end of each guide post.

Norell in U.S. Pat. No. 5,303,618 teaches a punch die used to punch minute via holes in ceramic wafers subsequently used in integrated circuit construction. After forming oversized holes, a multiplicity of punch pins are then pressed into the three layer sandwich and epoxied thereto to create an inexpensive punch die which then cooperates with a mechanically drilled die plate covered with a punch pin receiving perforated skin.

In U.S. Pat. No. 3,999,279, O'Neal discloses a method of making a punch assembly which utilizes a plastic resin to form multiple perforations in a frame associated with a punching mechanism for multiple selective perforation of a computer compatible card for use with a punch selector bank.

The above prior art references all deal primarily with the use of a curable or hardenable adhesive or epoxy associated with the equivalent of only one aspect or component of a punch set assembly. Therefore, the degrees of freedom which are permitted is thus limited and therefore the overall accuracy and precision with which the punch and associated punch guide and punch matrix of a three part punch assembly may be aligned is thus limited.

The present invention provides a method and combination punch set assembly and guide/matrix body assembly which greatly increases the accuracy with which the punch set assembly may be installed. By allowing the punch matrix and the punch guide to be freely moved in limited fashion about all degrees of freedom associated therewith between the guide body and the matrix body, very precise alignment and orientation of each punch set assembly and with respect to all other such punch set assemblies installed into a given guide/matrix body assembly is highly increased.

BRIEF SUMMARY OF THE INVENTION

This invention is directed to a guide body/matrix body assembly and a precision punch set assembly and method, the combination forming a precision punching system for highly accurate registration hole placement in film and plate sheet material used in subsequent precision alignment thereof on printing presses and image platemaking. The punch set assembly includes a punch guide and a punch matrix which are precision installed into the guide body and matrix body, respectively, in highly accurate fashion with respect to substantially all lineal and rotational degrees of freedom through the use of slightly oversized holes in the guide body and matrix body and a curable adhesive which fixes the precision alignment when cured. Vibration applied to the guide body/matrix body assembly during precision alignment and orientation of the punch set assembly is preferred.

It is therefore an object of this invention to provide a method of installing a punch set assembly into a guide body/matrix body assembly for use in the extremely accurate punching of registration holes in film and plate materials used in imagesetting.

It is another object of this invention to provide a method of precision installing one or a plurality of punch set assemblies into a guide body/matrix body assembly which greatly simplifies and reduces the costs thereof.

It is still another object of this invention to provide a of precision installation of three part punch set assemblies into slightly oversize and less accurately machined holes with the use of a curable epoxy resin to secure the punch guides and punch matrix which are fairly moveable in limited fashion about all degrees of freedom prior to adhesive curing to achieve an optimal level of precision.

It is yet another object of this invention to provide a combination punch set assembly and guide body/matrix body assembly for the precision punching of registration holes in thin film plate material used in printing and imagesetting.

In accordance with these and other objects which will become apparent hereinafter, the instant invention will now be described with reference to the accompanying drawings.

DETAILED DESCRIPTION OF THE INVENTION

Figure 2:
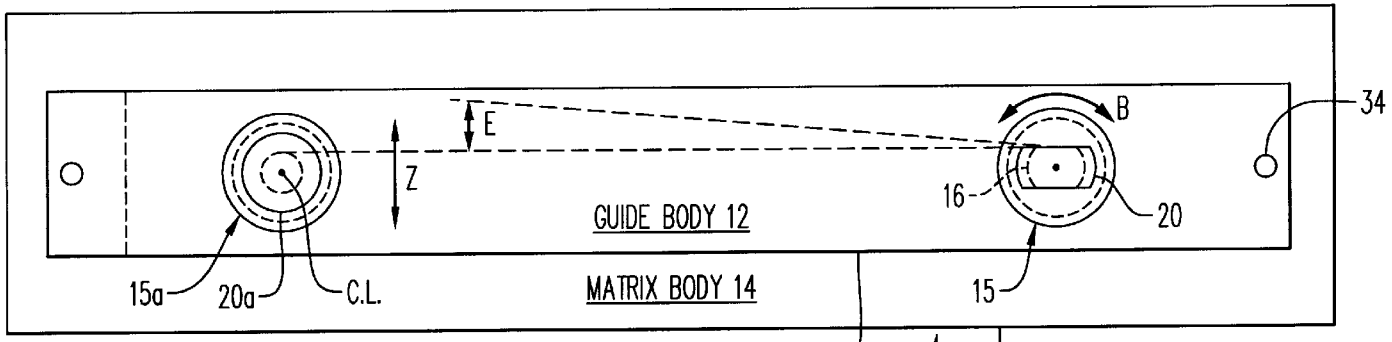
FIG. 2 is a top plan view of FIG. 1.

Referring now to the drawings, the invention is shown generally at numeral 10 and includes an elongated rigid guide body 12 connected by pins or threaded fasteners 34 atop a similarly sized generally coextensive matrix body 14. The guide body 12 and matrix body 14 are rigidly connected together so as to define an elongated slot or gap 36 of sufficient thickness so as to receive a sheet of film or plate media (not shown) used in imagesetters and plate making. The holes which are punched into each media sheet must be extremely accurately positioned and oriented with respect to other apertures punched therein prior to imaging or exposing of each media sheet, the punched holes in the media having been previously used to align each media sheet when the image is first established.

In addition to using round or circular holes, many imagesetters require that the holes include a flat or other non-circular surface for more accurate alignment of the media sheet when it is positioned in the image setter or printing press. Typically, the internal punch set assemblies require extremely high degrees of accuracy with very tight tolerances as indicated in the above Background section so as to achieve precision image alignment of a stacked plurality of exposed media sheets prior to printing.

The apparatus 10 includes a plurality of punch set assemblies 15 and 15*a*, each of which include the three components of a punch 16 and 16*a*, a punch guide 22 and 22*a* and a punch matrix 28 and 28*a*, respectively. One punch 16 typically has an enlarged head 20 including at least one flat surface thereon where the punch 16 is not circular as best seen in FIG. 2. The flat surface of the head 20 corresponds angularly to flat surfaces of the shape of the hole to be punched in the media sheet by punch 16.

The punch guides 22 and 22*a* each include a longitudinal aperture 24 and 24*a*, respectively, precision formed therethrough to exactly correspond to the shape of the body of the respective punch 16 or 16*a*. Thus, the longitudinal aperture 24 or 24*a* precisely guides the corresponding punch 16 or 16*a* into precise position within the punch guide 22 and 22*a*, respectively, ready for hole punching the media sheet positioned within slot 36. Apertures 30 and 30*a* of the corresponding punch matrix 38 and 28*a* have an upper opening precisely machined for the passing of the lower end 18 or 18*a* of punch 16 therethrough to effect the hole punching operation.

Figure 1:
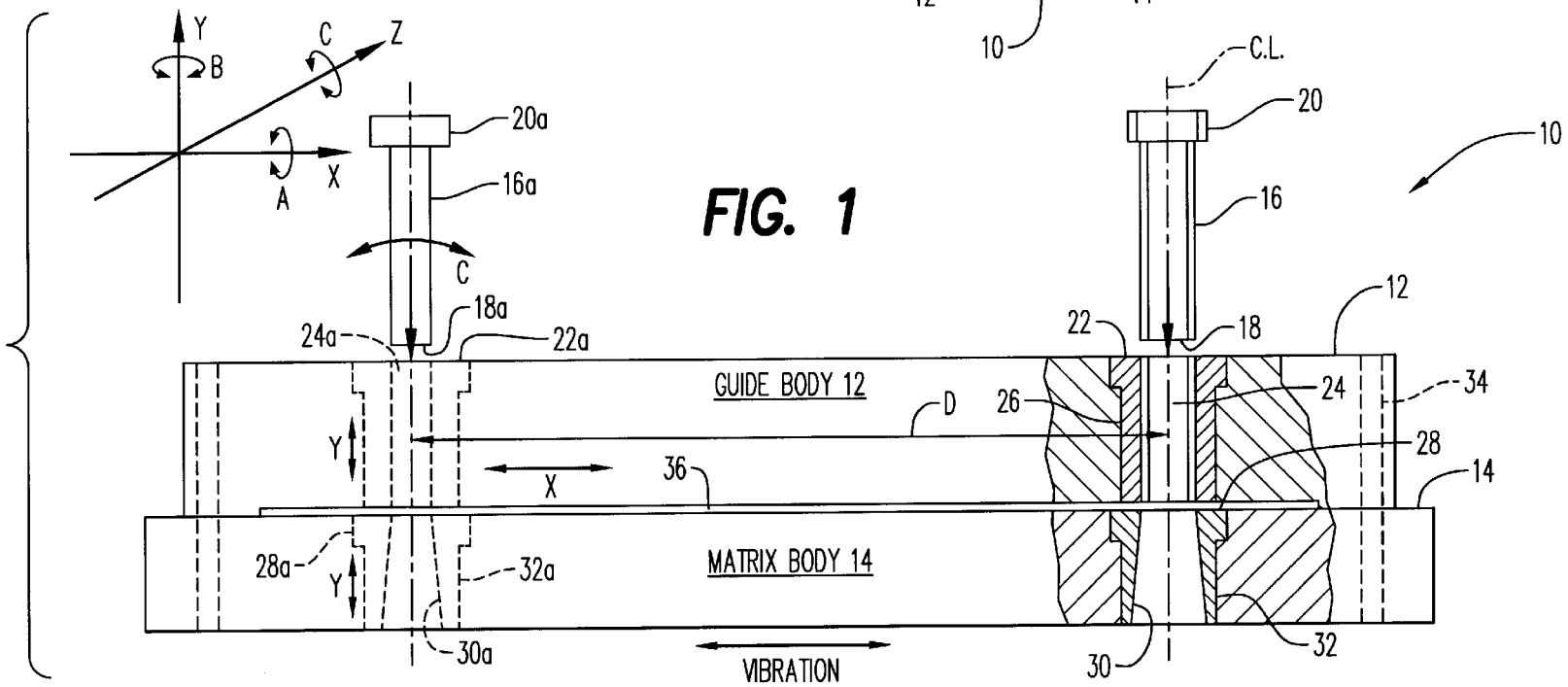
FIG. 1 is a side elevation partially broken view of the invention.

To achieve the extremely high degree of accuracy in the placement of each punch set assembly into the guide body 12 and matrix body 14, respectively, the utilization of a two-part epoxy curable resin is utilized in this invention. However, as it will be best understood hereinbelow, virtually all of the lineal degrees of freedom x, y and z, along with each of the appreciable rotational degrees of freedom a, b and c shown in FIG. 1, are accommodated for precision adjustment with respect to the relative orientation of each set of punch guides and punch matrix, as well as between each of the punch set assemblies before each layer of epoxy 26 and 32 cures and hardens.

To accomplish this adjustability in virtually all degrees of freedom of positional and rotational placement of each of the components of each punch set assembly, the following procedure is provided:

PUNCH SET ASSEMBLY INSTALLATION PROCEDURE

1. Matrix body is bored to 0.005" larger than the punch matrix.
2. Guide body is bored to 0.008" larger than the punch guide.
3. Industrial adhesive is applied to the punch matrix and it is inserted into the matrix body. Shims may be added to adjust height. Matrix surface is cleaned of excess adhesive. Repeat this procedure for all matrices.
4. Industrial adhesive is applied to the punch guide and it is inserted into the guide body. Repeat this procedure for all remaining punch guides.
5. Insert the punch into the guide and continue until the punch is fully engaged into the matrix. Repeat for all remaining punch sets.
6. Rotational alignment in the rotational direction of B about the longitudinal axes C.L. as shown at angle E in FIG. 2 is achieved by placing an accurate straight edge against the flat sides of the engaged punched head 20 and tapping or applying vibration to make the punch flats exactly parallel to adjacent punch set assemblies. Repeat for all punches with flat sides.
7. The adhesive is allowed to cure.

The following results toward the precision installation utilizing the above procedure have been achieved as follows:

Center to center accuracy D of +/0.003 inches

Guide to matrix alignment of 0.0002 inches

It should be obvious at this point that, with respect to the preferred embodiment of the punch guides and punch matrix which include an upper shoulder as shown, the guide body will have to be separated from the matrix body during machining and setting of at least the punch matrix into the bored hole, after which the guide body and matrix body are reassembled together and rigidly connected with bolts 34 before the epoxy has substantially cured.

A COMPARISON TO PRIOR ART

To more fully appreciate the heightened accuracy that the present invention provides, a comparison with respect to the degrees of freedom of movement obtainable by each of the prior art patent references is compared to that of the present invention in Table I herebelow.

TABLE I

| Degree of Freedom | Present Invention | 3,504,576 | 3,999,279 | 5,303,618 |
|---|---|---|---|---|
| Matrix to Guide | | | | |
| B radial | yes | no | no | no |
| X linear | yes | yes | yes | yes |
| Y linear | yes | yes | yes | yes |
| A angular | yes | no | no | no |
| C angular | yes | no | no | no |
| Z guide linear | yes | no | no | no |
| Z matrix linear | yes | no | no | no |
| Punch Set to Punch Set | | | | |
| X linear | yes | no | no | no |
| B radial | yes | no | no | no |

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A method of installing and precision aligning a plurality of spaced apart punch set assemblies each of which including a punch having an enlarged head including at least one flat surface thereon, a guide body and matrix body having a punch guide and punch matrix respectably therein, the punch guide and punch matrix having a shape corresponding to a body shape of the punch wherein the guide body and matrix body being rigidly connected together to form an assembly having a clearance therebetween for receiving film or plate printing sheets to be hole punched by said punch set assembly, comprising the steps of:

A. forming a first hole in said matrix body substantially larger than said punch matrix to allow small lineal and rotational movement of each said punch matrix within a corresponding said first hole;

B. forming a second hole in said guide body in axially alignment with said first hole and substantially larger than said punch guide to allow small lineal and rotational movement of each of said punch guide within a corresponding said second hole;

C. applying a curable adhesive around said punch matrix, then inserting each said punch matrix into the corresponding said first hole;

D. applying a curable adhesive around said punch guide, then inserting each said punch guide into the corresponding said second hole;

E. rigidly connecting said guide body and the matrix body before the adhesive has substantially cured;

F. inserting said punch through said punch guide and into said punch matrix whereby said punch matrix and said punch guide are aligned one to another axially and with respect to all other degrees of freedom about a longitudinal axis of said punch;

G. holding a precision straight surface against and between the flat edge on the head of said punch and the flat surface on the head of another said punch to align said punch set assemblies respect to one another;

H. allowing said adhesive to cure to fix the alignment between each said punch guide and punch matrix established in step F–G;

I. removing said punch.

* * * * *